United States Patent [19]

Difonzo et al.

[11] Patent Number: 4,604,972

[45] Date of Patent: Aug. 12, 1986

[54] SEAL ASSEMBLY FOR A VAPOR GENERATOR

[75] Inventors: Alexander J. Difonzo, North Plainfield; Venkatraman Seshamani, Gillette, both of N.J.

[73] Assignee: Foster Wheeler Energy Corporation, Livingston, N.J.

[21] Appl. No.: 710,653

[22] Filed: Mar. 11, 1985

[51] Int. Cl.[4] ..... F22B 37/24

[52] U.S. Cl. ..... 122/510; 110/263; 122/4 D; 122/6 A; 165/82

[58] Field of Search ..... 110/245, 263, 171, 165 R; 122/4 D, 6 A, 231, 235 D, 360, 365, 510, 511, DIG. 11, 209 R, 224; 165/82

[56] References Cited

U.S. PATENT DOCUMENTS

| | | | |
|---|---|---|---|
| 2,275,652 | 3/1942 | Pursel | 110/165 R |
| 2,337,634 | 12/1943 | Berry | 110/165 R |
| 3,208,436 | 9/1965 | Godshalk | 122/510 |
| 3,814,174 | 6/1974 | Beggs | 165/82 |
| 3,834,328 | 9/1974 | Blazewicz et al. | 110/165 R |
| 4,183,330 | 1/1980 | Bryers et al. | 122/4 D |
| 4,228,767 | 10/1980 | Smith et al. | 122/4 D |
| 4,300,457 | 11/1981 | Moore | 110/171 |
| 4,326,556 | 4/1982 | Deutsch et al. | 110/171 |
| 4,359,949 | 11/1982 | Moore | 110/171 |
| 4,510,892 | 4/1985 | Wincze et al. | 122/510 |

*Primary Examiner*—Albert J. Makay
*Assistant Examiner*—Steven E. Warner
*Attorney, Agent, or Firm*—Marvin A. Naigur; John E. Wilson; Warren B. Kice

[57] ABSTRACT

A seal assembly for a vapor generator each wall of which has spaced lower and an upper portions to accommodate relative movement there between. The seal assembly includes a trough containing water and connected to one of the portions of each wall. A dip skirt extends into the trough and divides same into an inner chamber and outer chamber, and a partition extends from the dip skirt, across the space between the wall portions, and to the other wall portion to expose the water in the inner chamber to the boiler pressure and the water in the outer chamber to atmosphere. As a result, relative movement between the wall portions is accommodated by corresponding movement of the dip skirt in the water trough while maintaining an airtight seal.

4 Claims, 3 Drawing Figures

SEAL ASSEMBLY FOR A VAPOR GENERATOR

BACKGROUND OF THE INVENTION

This invention relates to a vapor generator and more particularly to a vapor generator which incorporates a fluidized bed furnace portion that has been retrofitted in place of a conventional burner-type design.

The use of fluidized beds has long been recognized as an attractive way of generating heat. In a fluidized bed arrangement air is passed through a perforated plate, or grid, supporting particulate fuel material. As a result of the air passing through the bed, the bed behaves like a boiling liquid which promotes the combustion of fuel. The basic advantages of such an arrangement include a relatively high heat transfer rate, a substantially uniform bed temperature, combustion at a relatively low temperature, ease of handling the coal, a reduction in corrosion and boiler fouling, and a reduction in boiler size.

Fluidized beds have enjoyed increased popularity especially with the advent of stringent pollution control requirements, since a material can be placed in the fluidized bed which absorbs the sulfur generated as a result of the combustion of the particulate fuel, resulting in a substantial reduction in air pollution.

These type of fluidized beds lend themselves to use in a vapor generator in which the heat from the bed is used to heat water flowing through heat exchange tubes, some of which form the walls of the generator. However, it is very difficult to retrofit an existing vapor generator incorporating a burner-type furnace with a fluidized bed furnace. One of the main reasons for this is that the vapor generator is usually top supported, i.e., the vapor generator hangs from a support system connected to its upper portion, while the fluidized bed is too heavy to be supported in such a manner and thus must rest on the floor. However, this presents the problem of joining the top of the fluidized bed module, which is relatively stationary, to the bottom of the boiler which thermally expands down and out. Thus a seal is required, but any type of metallic multifold type seal, or the like, would result in an extremely expensive expansion joint seal which, do to the stresses imposed by the differences in thermal expansion, would be susceptible to cracking and thus create potential maintenance problems.

SUMMARY OF THE INVENTION

It is therefore an object of the present invention to provide a seal assembly which eliminates the problems associated with prior seal devices between a vapor generator and a retrofitted fluidized bed module.

It is a further object of the present invention to provide a seal assembly of the above type which seals a convection section of the vapor generator from a retrofitted fluidized bed module.

Is is a still further object of the present invention to provide a seal assembly of the above type which accommodates relative thermal expansion between the fluidized bed module and the remaining section of the vapor generator.

Toward the fulfillment of these and other objects, the seal assembly of the present invention comprises a trough containing water and connected to the fluidized bed section or the convection section of the vapor generator. A dip skirt extends into the trough and divides same into a inner chamber and outer chamber. A partition extends from the dip skirt across the space between the wall portions of the convection section and the fluidized bed section and to the wall of the other section to expose the water in the inner chamber to the boiler pressure and the water in the outer chamber to atmosphere. As a result, relative movement between the wall portions results in a corresponding movement of the dip skirt and the trough, and relative changes in pressure within the furnace section causes a movement of the two reservoirs of water.

BRIEF DESCRIPTION OF THE DRAWINGS

The above brief description as well as further objects, features and advantages of the present invention will be more fully appreciated by reference to the following detailed description of presently preferred, but nonetheless illustrative embodiments in accordance with the present invention when taken in conjunction with the accompanying drawings wherein.

DESCRIPTION OF THE PREFERRED EMBODIMENT

Figure 1:
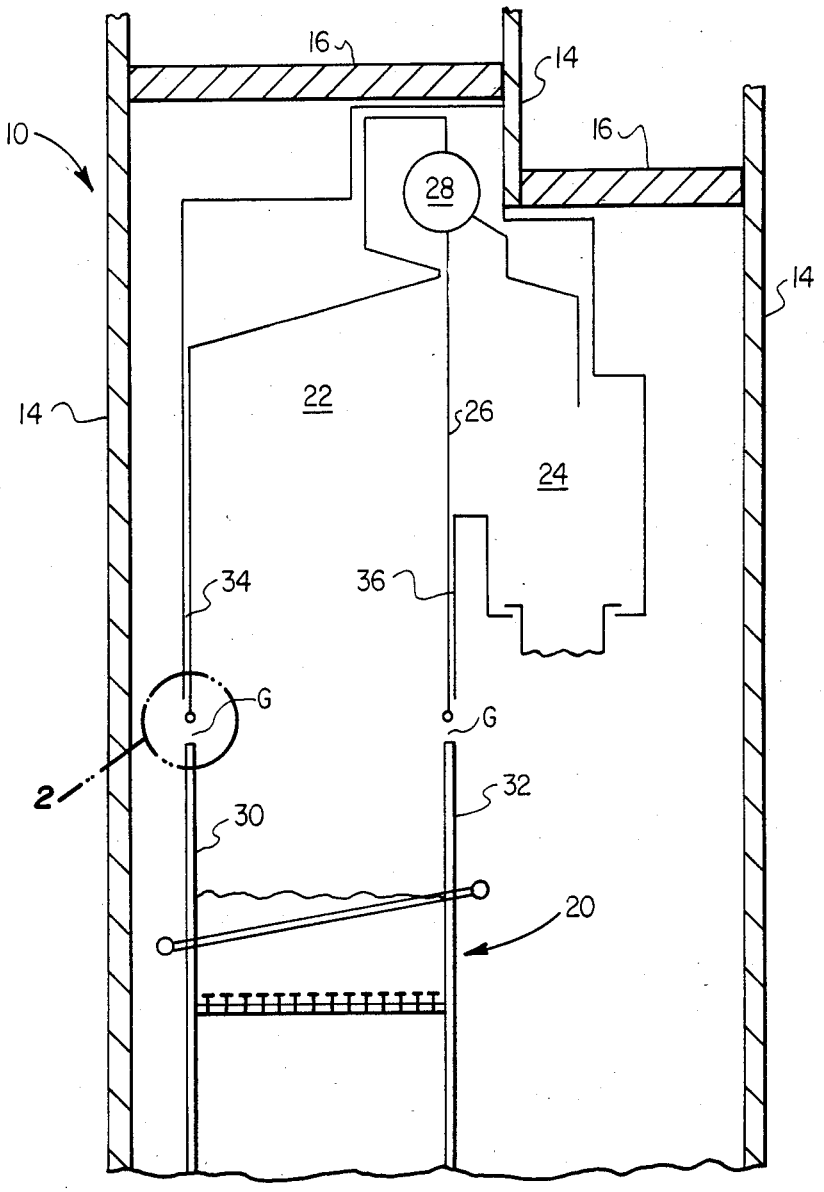
FIG. 1 is partial sectional view and schematic view of a vapor generator incorporating a retrofitted fluidized bed module.

Referring specifically to the drawings, the reference numeral 10 refers, in general, to a vapor generator which incorporates the seal assembly of the present invention. The vapor generator includes a top support assembly 12 including vertical beams 14 and horizontal beams 16 which, through conventional hardware, support the basic components of the vapor generator so that it hangs from the assembly. Since the top support assembly and the manner in which it supports the latter components is conventional, it will not be described in any further detail.

A fluidized bed furnace module 20 is disposed just below a freeboard section 22 of the vapor generator 10. A convection section 24 is disposed to the side of the freeboard section 22 and separated therefrom by a wall 26. The vapor generator 10 is a natural circulation type, and to this end, the walls forming the sections 22 and 24 as well as the wall 26, are formed by a plurality of water wall tubes connected and disposed in a conventional manner to form a fluid flow circuit including a steam drum 28 and additional associated circuitry (not shown).

As discussed above, the seal assembly of the present invention is especially suited to situations in which the fluidized bed furnace module 20 has been retrofitted in place of a conventional burner-type furnace in order to improve the efficiency of the vapor generator.

Since the module 20 is too heavy to be supported by the top support assembly 12, it must rest on the floor of the plant. To this end, the seal assembly of the present invention is designed to render the connection between the module 20 and the convection section 22 airtight, yet accommodate differences in thermal expansion between the floor mounted module 20 and the remaining top-supported structure of the vapor generator 10 including the freeboard section 22, the convection section 24 and the steam drum 28.

The module 20 is installed immediately below the convection section 22 with its front and rear walls 30 and 32, respectively, in alignment with the front and rear walls 34 and 36 respectively, of the convection section 22. A gap G is formed between the upper ends of the walls 30 and 32 and the lower ends of the walls 34 and 36 to accommodate differences in thermal expansion between the respective walls.

Although only the front walls and rear walls of the furnace module 20 and the convection section 22 are shown, it is understood that the side walls of each section are formed in an identical manner.

Figure 2:
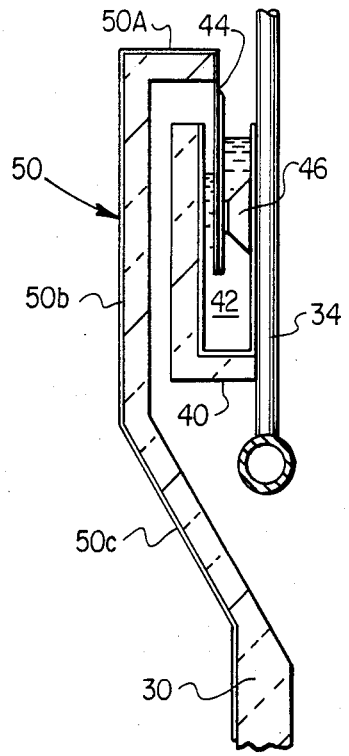
FIG. 2 is a enlarged view depicting the seal assembly of the present invention as applied to the vapor generator of FIG. 1.

The seal assembly of the present invention is shown in FIG. 2 and, although shown only in connection with the furnace module front wall 30 and the convection section front wall 34, it is understood it extends around the complete perimeter of the interface between the furnace module 20 and the convection section 22.

Referring to FIG. 2, the reference numeral 40 refers in general to a trough shaped partition which is connected to the outer surface of the wall 34 and defines, with said wall, a water chamber 42. A dip skirt 44 extends within the water chamber 42 and rides against a guide 46 affixed to the outer surface of the wall 34. A partition 50 has a horizontal portion 50*a* to which the dip skirt 44 is connected, a vertical portion 50*b* which extends parallel to the wall 34 and an angular portion 50*c* which is connected to the upper end portion of the wall 30 of the fluidized bed module 20.

As a result, differences in thermal expansion between the wall 34 and the wall 30 are accommodated by corresponding vertical movement of the dip skirt in the chamber 42 and thus renders the interface between furnace module 20 and the convection section 34 airtight. Moreover, changes in internal furnace pressure is accommodated by changes in relative heights of the water level to either side of the dip skirt 44 in the chamber 42.

It is thus seen that the seal assembly of the present invention provides a complete and positive seal of the interior of the furnace module 20 and the convection section 22 while accommodating differences in thermal expansion of the walls 30 and 34.

As mentioned above, the seal extends completely around the perimeter of the furnace and thus involves the other side walls and the rear walls 32 and 26 of the furnace module 20 and the convection section 22, respectively.

Figure 3:
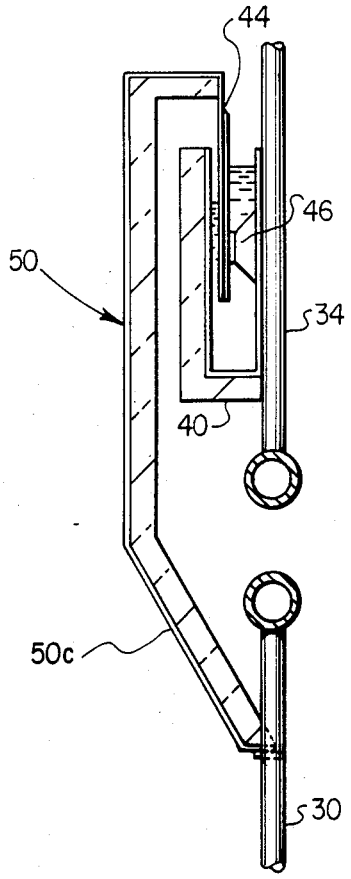
FIG. 3 is a view similar to FIG. 2, but showing an alternate embodiment of the present invention.

The embodiment of FIG. 3 is similar to that of FIG. 2 and identical components will be given the same reference numeral. In the embodiment of FIG. 3, the wall 30*a* of the fluidized bed module 20 is formed by a plurality of water tubes (one of which is shown) connected in an airtight manner. In this arrangement the angular portion 50*c* of the partition 50 is welded to the outer surface of the wall 30 and the seal assembly is otherwise formed in an identical manner to that described above.

Is thus seen that seal assembly of the present invention eliminates the problems associated with prior seal devices yet accommodates relative thermal expansion between the fluidized bed module and the remaining section of the vapor generator.

Other modifications, changes and substitutions are intended in the foregoing disclosure and in some instances some features of the invention will be employed without a corresponding use of other features. Accordingly, it is appropriate that the appended claims be construed broadly and in a manner consistent with the spirit and scope of the invention therein.

What is claimed is:

1. A seal assembly for a boiler, each wall of which has a lower portion and an upper portion spaced from said lower portion to accommodate relative movement between said portions, said seal assembly comprising a trough containing water connected to said upper portion of each wall; partition means having a first portion extending outwardly from said lower portion of each wall, a second portion extending from said first portion in a general parallel relation to said wall portions and across the space between said wall portions, and a third portion extending horizontally from said second portion towards said upper wall portion; and a dip skirt extending downwardly from said third partition portion and into said trough for accommodating said relative movement between said upper wall portion and said lower wall portion, and for dividing same into a first chamber containing water exposed to the boiler pressure and a second chamber containing water exposed to atmosphere.

2. The assembly of claim 1 wherein the end of said dip skirt is spaced from the floor of said trough to provide communication between said chambers so that differences in said boiler pressure from atmospheric pressure is accommodated by corresponding changes in the relative water level in said chambers.

3. The assembly of claim 1 further comprising means disposed in said trough for guiding the movement of said dip skirt.

4. The assembly of claim 1 wherein said movement of said dip skirt is in a vertical direction.

* * * * *